US005533732A

United States Patent [19]

Leinen, Sr. et al.

[11] Patent Number: 5,533,732

[45] Date of Patent: Jul. 9, 1996

[54] INSTANT RESPONSE TARGET SYSTEM

[76] Inventors: James A. Leinen, Sr.; Carolyn Leinen; James A. Leinen, Jr.; Tammy M. Leinen, all of N5392 County Rd. J, Tigerton, Wis. 54486

[21] Appl. No.: 499,106

[22] Filed: Jul. 6, 1995

[51] Int. Cl.[6] ..... F41J 5/18

[52] U.S. Cl. ..... 273/375; 273/392; 273/406

[58] Field of Search ..... 273/371, 374, 273/375, 376, 406, 390, 391, 392

[56] References Cited

U.S. PATENT DOCUMENTS

| | | | |
|---|---|---|---|
| 3,392,980 | 7/1968 | Ortega | 273/406 |
| 3,515,388 | 6/1970 | Zachmeier | 273/406 |
| 4,426,085 | 1/1984 | Dixon | 273/392 |
| 5,232,227 | 8/1993 | Bateman | 273/392 |
| 5,240,258 | 8/1993 | Bateman | 273/392 |

*Primary Examiner*—William H. Grieb

[57] ABSTRACT

An improved impact target, the instant response target system, has a base frame, an independent power source, and a support frame. An electrically energizing snap switch is carried on a bracket connected to the base frame. An electrical power source is independent and connected by wires to the snap switch. A target and an impact plate are carried on the support frame by two pillow blocks and two steel pins counter balanced by a counter weight and counter weight adjuster. The bullet impact pushes the target off the snap switch energizing the light.

1 Claim, 1 Drawing Sheet

INSTANT RESPONSE TARGET SYSTEM

BACKGROUND OF THE INVENTION

The instant invention relates generally to targets and more specifically it relates to improved target impact response, which provides an instant light response upon bullet impact.

There are various steel reactive targets which do not provide the novelty improvements of the instant light response target herein disclosed.

SUMMARY OF THE INVENTION

A primary object of the present invention is to provide an impact system for all shooters, right or left handed, including the handicap with an instant light response results and without the required reset time and effort of prior art.

Another object is for improved quick response skills and improved concentration on target.

A further object is to provide an impact target system that is simple and easy to assembly and use.

Additional object is to provide an impact target system that is economical in cost to manufacture and that has replacement target plates for additional economic value.

Another object is that it could be used with a variety of caliber: twenty two long rifle, twelve gauge slug, thirty-thirty, with same range and counter weight adjuster setting.

An additional object is that it could be used with larger caliber at increased range with minor adjustment of the counter weight adjuster setting.

Another object is the safety factor without travel downrange for resets.

An additional object is it would be safer with less chance of ricochet after bullet impact.

A still further object of this invention is the use of an instant light response, which could be white or colored light or sound, buzzer, or bell, to bullet impact.

Further objects and advantages of our invention will become apparent from a consideration of the drawing and description to follow.

DETAILED DESCRIPTION OF THE PREFERRED EMBODIMENTS

Figure 1:
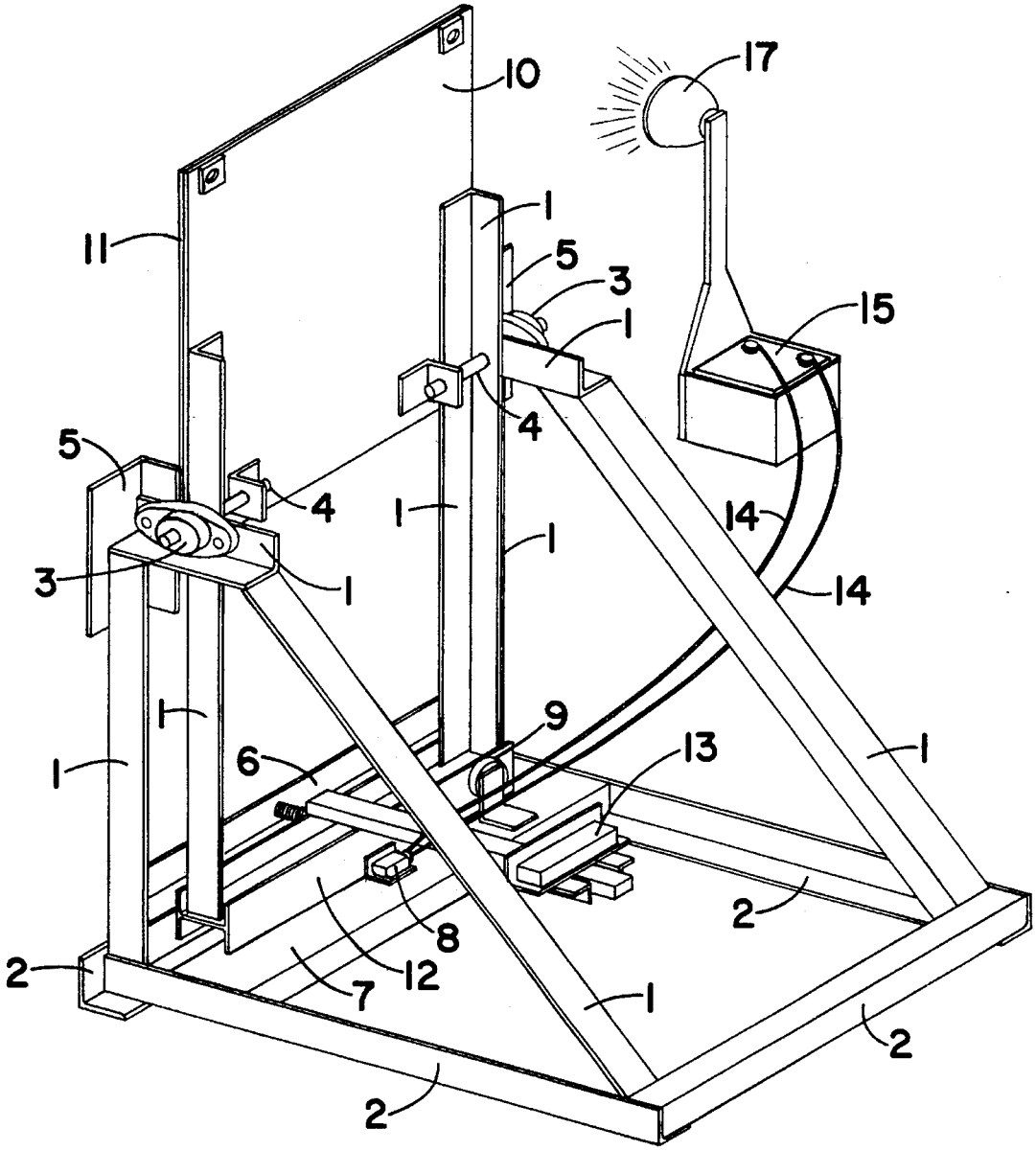
FIG. 1 is an elevation side view of the instant invention.

Descriptively, the drawing illustrates the instant response target system, FIG. 1 which consists of a support frame 1 and a base frame 2. Two pillow blocks with bearings 3 and steel pins 4 and bearing shields 5 are located on the support frame 1. A return spring and support 6 are mounted to the support frame 1. A bracket 7 connected to the base frame 2 carries the electrical snap switch 8 and counter weight stop 9. The impact plate 10, target 11, counter weight 12 and counter weight adjuster 13 are connected to two pillow blocks with bearings 3 using two steel pins 4.

The power source is energized, within a half second, by the bullet striking the target 11 forcing the counter weight 12 off the pressure release snap switch 8 which is controlled by the swivel point of two pillow block bearings 3 and two steel pins 4, closing the circuit through wires 14 from the battery 15 to the snap switch 8 to the light 17 for twelve volt direct current turning the light 17 on, which is independently mounted either to the left or right of the target 11. The counter weight 12 contacts the return spring and support 6, which returns the counter weight 12 back to the snap switch 8 and counter weight stop 9, opening the circuit, turning the light 17 off.

While the above description contains certain features this should not be construed as limitations on the scope of the invention, but rather as one description, and it will be understood that various omissions, changes, and substitutions in the forms and details of the device and in its operation can be made by those skilled in this field without departing from the spirit of the invention.

What is claimed is:

1. An instant response target system which comprises:

a) a support frame and a base frame;

b) two pillow blocks with bearings and bearing shields carried on said support frame;

c) a return spring and support carried on said support frame;

d) a bracket carried on said base frame;

e) an electrical snap switch and counter weight stop carried on said bracket connected to said base frame;

f) an impact plate, target, counter weight, and counter weight adjuster are carried by said two pillow blocks with bearings and two steel pins which are carried on the support frame; and g) a light and a battery which are independent of the instant response target, the light energized through wires that connect the electrical snap switch which is carried on the bracket, wherein energizing of the light occurs by a bullet impact on the target forcing the counter weight with counter weight adjuster off the pressure release snap switch, thereby closing a circuit through the wires connecting the battery, the switch and the light, followed by the counter weight with counter weight adjuster contacting the return spring which returns the counter weight and counter weight adjuster against the counter weight stop and snap switch, opening the circuit, turning the light off.

* * * * *